United States Patent [19]

Knorr

[11] 4,200,047

[45] Apr. 29, 1980

[54] TWO PART GRATE FOR STOKERS WITH RECIPROCATING GRATE PLATES

[75] Inventor: Günter Knorr, Hamburg, Fed. Rep. of Germany

[73] Assignee: Claudius Peters AG, Hamburg, Fed. Rep. of Germany

[21] Appl. No.: 917,576

[22] Filed: Jun. 21, 1978

Related U.S. Application Data

[63] Continuation-in-part of Ser. No. 888,790, Mar. 21, 1978, abandoned.

[30] Foreign Application Priority Data

Apr. 1, 1977 [DE] Fed. Rep. of Germany ..... 2714600

[51] Int. Cl.[2] ..... F23B 1/22

[52] U.S. Cl. ..... 110/281; 110/268

[58] Field of Search ..... 110/281, 282, 268, 269

[56] References Cited

U.S. PATENT DOCUMENTS

| | | | |
|---|---|---|---|
| 2,806,439 | 9/1957 | Wagner | 110/282 |
| 3,322,414 | 5/1967 | Boron | 110/269 |
| 4,018,168 | 4/1977 | Andreoli et al. . | |

*Primary Examiner*—Edward G. Favors

*Attorney, Agent, or Firm*—Otto John Munz

[57] ABSTRACT

A two part grate includes separable front and rear grate plate parts releasably supported on a grate support member. The two part grate is secured to the grate support by a fastener engaged with the front grate plate part and with the grate support member, and the front and rear grate plate parts have interengaging structure whereby the engagement of the front grate plate part with the rear grate plate part holds the rear grate plate part downwardly against the grate support.

10 Claims, 4 Drawing Figures

TWO PART GRATE FOR STOKERS WITH RECIPROCATING GRATE PLATES

RELATED APPLICATIONS

This application is a continuation-in-part of U.S. application Ser. No. 888,790, now abandoned filed Mar. 21, 1978 and entitled "Two Part Vertical Mill Grate For Stokers With Reciprocating Grate Bars".

Priority of German application No P 27 14 600.5 filed Apr. 1, 1977 is claimed under the Convention.

FIELD OF THE INVENTION

This invention relates to grates for stokers with reciprocating grate bars, such as used in refuse incinerators and cooling devices. Such grates are shown, for example, in U.S. Pat. Nos. 3,624,920, 3,961,588, and 3,374,553.

More particularly, the invention relates to a two part grate. German Pat. No. 1,134,329 shows a conventional two part grate, wherein the two grate parts are detachably joined by hook or hinge connections and pressed against the grate support by a spring-mounted bolt. The hook engaged by the bolt is located at the bottom side of the rear grate part.

BACKGROUND OF THE INVENTION

These prior art grates, including the two part grates, as well as the one part grates, are not subjected to uniform thermal stress when in use. This is especially true of the one part grates, and the temperature variations and uneven thermal stresses produced are particularly a problem in refuse incinerators.

Due to the temperature variations in the grate, and the uneven thermal stresses produced, the surface of the rear portion of the grate typically shrinks; and particularly in the two part grates, the rear grate portion is lifted off of the grate support. This lifting process is amplified by the fact that the fastening bolt engages the bottom side of the rear grate part only and pulls the rear grate part downward. As a result of this lifting off, the grate comes into contact with the superposed grate. Increased wear occurs, and in extreme cases the stoker comes to a standstill.

Thus, in accordance with the present invention, means is provided for holding the front grate part downwardly against the grate support, and the front and rear grate parts have interengaging means thereon whereby the front grate part holds the rear grate part downwardly to the grate support. The structure of the present invention is such that the rear grate part is not subjected to a non-uniform downward pull, as in the prior art, and in the event of thermal shrinkage will not be lifted off of the grate support.

Moreover, the rear grate part of the invention rests at four points on the grate support, and if a thermal shrinkage occurs, will be bent uniformly downwardly as a result of the four point rest.

Additionally, cooling slots and openings are provided in the grate of the invention for flow of cooling air for reducing the temperature variations and thermal stresses in the grate.

SUMMARY OF THE INVENTION

The present invention comprises a two part grate including a front grate part and a rear grate part. The front grate part is releasably held downwardly relative to a grate support by means of a resiliently biased fastening member engaged with the grate support and with the front grate part. The front and rear grate parts have interengaging means thereon whereby the front grate part serves to hold the rear grate part downwardly against the grate support and projections on the underside of the adjacent portions of the front and rear grate parts are arranged to engage the adjacent grate part to prevent any substantial relative vertical or horizontal movement between the front and rear grate parts.

The projections on the rear grate part in addition engage the grate support to prevent rearward movement of the rear grate part relative to the grate support and the interengaging portions of the front and rear grate parts produce both horizontal and vertical force components with the horizontal force component acting in a rearward direction. The fastening member extends upwardly at an angle from the grate support into engagement with the projections on the underside of the front grate part and horizontal and vertical force components are produced by the fastening means. Thus, the front grate part is pulled downwardly and rearwardly against the rear grate part and the projection on the rear grate part prevents rearward movement of the rear grate part whereby both the front and rear grate parts are securely held against the grate support by means of the resiliently biased fastening member and the interengaging surfaces and projections on the front and rear grate parts.

Further, the front grate part has cooling slots in its forward portion for passage of cooling air therethrough to reduce temperature variations in the front grate part and thereby minimize thermal stresses. A cooling opening is also provided between the front and rear grate parts for passage of cooling air therethrough to cool the projections on the front and rear grate parts.

More specifically, the grate support includes transverse plates having longitudinally extending grate fingers thereon and the front and rear grate parts are supported on the grate fingers. The rear grate part is structured such that is has a four point rest on the grate fingers and if thermal shrinking of the rear grate part occurs the surface of the rear grate part will be bent uniformly downwardly as the result of the four point rest. The front grate part has laterally spaced apart, longitudinally extending ribs on the underside thereof which are aligned with and supported on the grate fingers for supporting the front grate part on the grate support.

With the above described structure, even if the tension of the spring on the fastening bolt decreases the rear grate part will not become detached and drop out, nor will the front grate part shift relative to the rear grate part and be deflected upwardly whereby it would offer resistance to movement of material conveyed on the grate.

OBJECTS OF THE INVENTION

It is an object of this invention to overcome the problems mentioned herein in connection with prior art grates, and to provide a two part grate wherein lifting of the rear grate part from the grate support is avoided.

Another object of the invention is to provide a two part grate which can be installed and removed at any position of the stoker.

Still another object of the invention is to provide a grate wherein temperature variations and thermal stresses in the grate are minimized.

A further object of the invention is to provide a two part grate, in which the front grate part is held downwardly to the grate support by a fastening means and the rear grate part is held downwardly by the front grate part.

A still further object of the invention is to provide a two part grate wherein the front grate part of the grate, which is usually subjected to the greatest wear, is easily replaceable; and further wherein the rear grate part may be made of less expensive material, and standardized in shape, size and form for reduced inventory requirements.

An even further object of the invention is to provide a two part grate in which temperature variations and the thermal stresses are minimized, and wherein lifting of the rear grate part from the grate support is avoided, the two part grate being suitable for either horizontal or inclined grates, and being either flat, or ascending in the direction of conveyance of material.

A more specific object of the invention is to provide a two part grate, wherein the front grate part is held downwardly to the grate support by a resiliently biased fastener and the rear grate part is held downwardly to the grate support by the front grate part, said front and rear grate parts having interengaging means which prevent excessive relative vertical and horizontal movement between the front a rear grate parts.

DETAILED DESCRIPTION OF THE PREFERRED EMBODIMENT

Figures 1, 2:
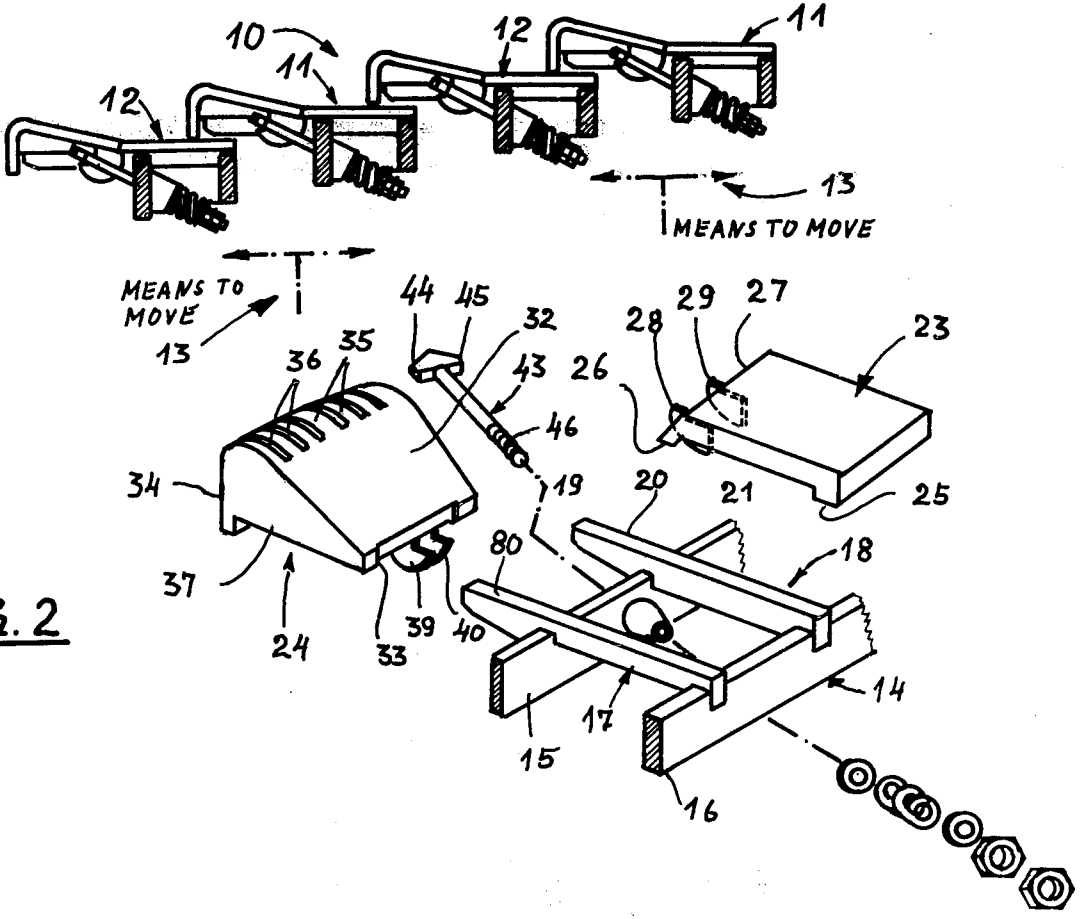
FIG. 1 is a view in elevation of a series of alternate fixed and movable grates in accordance with the invention.
FIG. 2 is an exploded perspective view of the two part grate of the invention and its grate support.

In the drawings, wherein like reference numerals indicate like parts throughout the several views, a series of alternate fixed and reciprocating grate plates according to the invention is indicated generally at 10 in FIG. 1 and comprises a plurality of reciprocating grate plates 11 alternatingly interposed with a plurality of fixed grate plates 12. Suitable, conventional means for moving the reciprocating grate plates 11 is indicated diagrammatically at 13.

Figure 3:
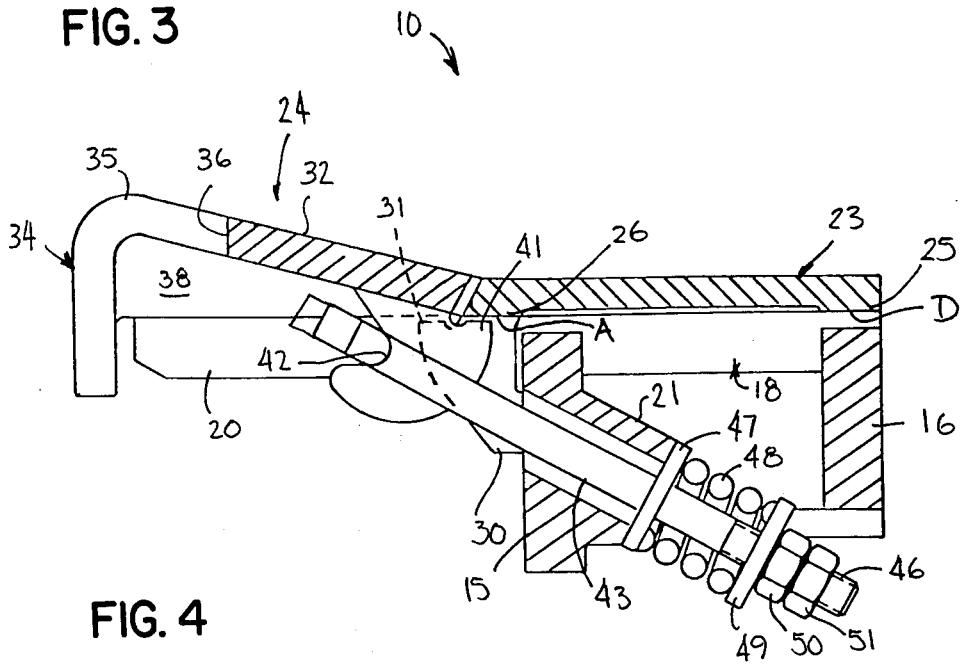
FIG. 3 is a longitudinal vertical sectional view of the grate of the invention and its support.
Figure 4:
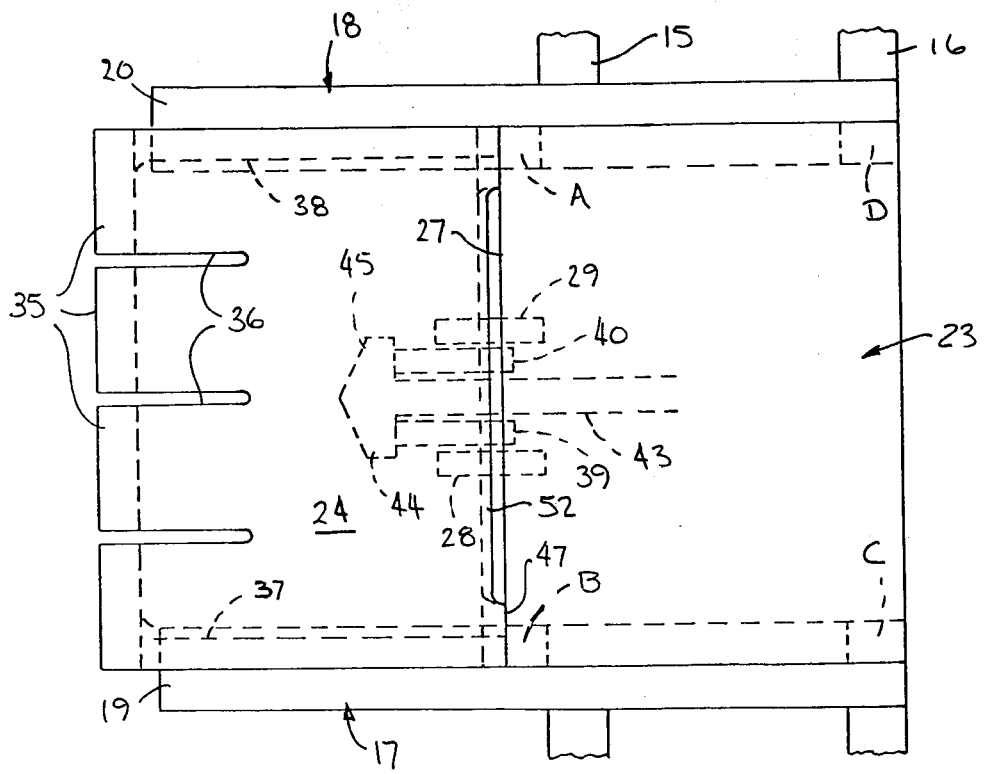
FIG. 4 is a plan view of the grate and support of the invention.

Referring to FIGS. 2, 3 and 4 wherein details of construction of the two part grate of the invention can best be seen, one of the reciprocating grates 11 is illustrated. Since the construction of the reciprocating grates 11 and the fixed grates 12 is substantially the same, only the reciprocating grate 11 will be described, description of that grate serving as a description for both. The grate 11 comprises a grate support 14 including a pair of substantially parallel, elongate, laterally extending support plates 15 and 16 on which a pair of longitudinally extending laterally spaced apart, substantially parallel grate fingers 17 and 18 are suitable fixed for each grate carried by the plates 15 and 16. The grate support fingers 17 and 18 have forwardly extending end portions 19 and 20 projecting forwardly beyond the front grate plate 15.

The front grate plate 15 has a rearwardly and downwardly projecting boss 21 formed thereon with a central opening 22 therethrough.

The two part grate comprises a rear grate part 23 and a front grate part 24. The rear grate part 23 has a pair of laterally extending downwardly projecting feet or flanges 25 and 26 thereon at the rear and front edges thereof respectively, whereby when the rear grate part is supported on the grate fingers 17 and 18 a four point rest is obtained at points A,B,C and D as seen in FIG. 4. Additionally, the forward end surface of the rear grate part 23 slopes upwardly and rearwardly as at 27, and a pair of downwardly extending projections 28 and 29 are formed on the underside of the rear grate part at the forward edge surface thereof. The projections 28 and 29 each have a rearwardly extending foot portion 30, and a forwardly extending retaining flange or web 31 projecting forwardly beyond the sloping end surface 27.

The front grate portion 24 has an upwardly sloping plate or body 32 terminating at its rearward end surface in a downwardly sloping surface 33 complemental to the sloping surface 27 on rear grate part 23. The forward end portion of front grate part 24 extends substantially vertically downwardly at 34 and is subdivided into a plurality of fingers 35 by means of longitudinally extending slots 36 formed in the forward end portion. A pair of side walls or ribs 37 and 38 are formed at the opposite sides of the front grate portion 24 for engagement on the forwardly extending portions 19 and 20 of grate support fingers 17 and 18. A pair of downwardly projecting hook members 39 and 40 are formed on the underside of the front grate portion 24 adjacent the rear edge surface 33 thereof and include rearwardly projecting detents 41 and a concave forward edge configuration defining a hook 42.

A fastening member for securing the grate parts to the support comprises an elongate T-bolt 43 having laterally extending projections 44 and 45 on one end thereof and external threads 46 on the other end. As seen on FIG. 3, when the grate parts are assembled to the grate support the threaded end of the T-bolt 43 is adapted to extend through the opening 22 formed in the front grate support plate 15 and its boss 21 with the projections 44 and 45 engaged with the hook configuration 42 of the hook members 39 and 40 on the front grate part. A washer 47 is disposed over the T-bolt and against the end of the boss 21 and a coil spring 48 is disposed around the projecting end of the T-bolt. A second washer 49 is engaged against the end of the spring 48 and a nut 50 is theaded onto the threaded end 46 of the bolt to securely urge the front grate part 24 downwardly and rearwardly. A jam nut or lock nut or the like 51 may also be threaded on the T-bolt to prevent inadvertent loosening of the nut 50.

Additionally, and as seen best in FIG. 4, the rear edge surface 47 of the front grate part 24 is cut away or formed with a depression 52 over a substantial portion of its length thereby defining a cooling slot through which cooling air may pass to effect cooling of the projections 28, 29 and 39 and 40.

With the parts assembled as seen in FIGS. 3 and 4, the edge surfaces 27 and 47 of the rear grate part 23, and front grate part 24, respectively, abut against one another and the foot portion 30 of projections 28 and 29 on the rear grate part engage against the front of grate support plate 15 to prevent rearward movement of the rear grate part 23 when the nut 50 is tightened on the T-bolt 43 to compress spring 48 and pull downwardly against the hook members 39 and 40 of front grate part 24, thereby urging the ribs 37 and 38 of front grate part downwardly against the fingers 19 and 20. The sloping T-bolt 43 produces both a horizontal and vertical force component on the hook members 39 and 40, which force components are transmitted through the mating, sloping edge surfaces 27 and 47 to the rear grate part 23 urging it rearwardly and downwardly against the fingers 17 and 18 and with the foot portions 30 urged against the front of grate support plate 15. The forwardly extending detents or projections 31 on the projections 28 and 29 of rear grate part extend beneath the rearward edge of front grate part 24 to prevent upward movement of the rear grate part relative to the front grate part. Likewise, the rearwardly extending detents 41 of the hook members 39 and 40 project beneath the forward edge portion of rear grate part preventing upward movement of the front grate part relative to the rear grate part.

Thus, the front and rear grate parts of the two part grate of the invention are securely, yet resiliently held downwardly against the grate support; and the front grate part 24, which is subject to the greatest wear, may be be easily replaced. Further, the rear grate parts 23, may be made in standard shape and size for reduction in inventory and cost, and they are constructed such that they have a four point engagement with the grate support fingers, thereby reducing or eliminating the likelihood of upward movement of the rear grate part in response to thermal shrinkage.

As this invention may be embodied in several forms without departing from the spirit or essential characteristics thereof, the present embodiment is, therefore, illustrative and not restrictive since the scope of the invention is defined by the appended claims rather than by the description preceding them and all changes that fall within the metes and bounds of the claims or that form their functional as well as conjointly cooperative equivalents are therefore intended to be embranced by those claims.

What is claimed is:

1. A two part grate for stokers with reciprocating grate plates, comprising:

a grate support having a front wall surface and grate supporting top surfaces;

a two part grate secured to the grate support and including a rear grate part and a front grate part, said front and rear grate parts supported on the top grate supporting surfaces;

releasable fastening means holding the two part grate downwardly on the grate support, said fastening means engaged with the front grate part urging the front grate part rearwardly and downwardly; and interengaging means on the front and rear grate parts preventing substantial relative horizontal and vertical movement therebetween, whereby the front grate part holds the rear grate part of the grate support.

2. A two part grate as claimed in claim 1, wherein the interengaging means includes inclined end surfaces on the front and rear grate parts producing horizontal and vertical force components, whereby the rearward and downward urging of the front grate part is transmitted to the rear grate part in the form of horizontal and vertical force components.

3. A two part grate as claimed in claim 2, wherein the interengaging means further includes projection means on the underside of the front grate part extending beneath the forward edge of the rear grate part, and projection means on the underside of the rear grate part extending beneath the rearward edge of the front grate part, said last named projection means also having a foot engaged against the grate support preventing horizontal movement of the rear grate part rearwardly relative to the grate support.

4. A two part grate as claimed in claim 3, wherein the projection means on the underside of the front grate part comprises a pair of spaced apart hook members, said fastening means being engaged with said hook members to pull said front grate part rearwardly and downwardly.

5. A two part grate as claimed in claim 4, wherein the fastening means comprises an elongate bolt extending in an upwardly and forwardly inclined direction through an opening in the grate support and having a T-shaped end engaged with the hook members on the front grate part and threaded end projecting beyond the grate support, spring means received on the threaded end, and nut means threaded on the bolt, compressing the spring and resiliently urging the grate parts downwardly and rearwardly relative to the grate support.

6. A two part grate as claimed in claim 5, wherein the grate support comprises a pair of laterally extending, substantially parallel plates spaced apart in the direction of movement of the grate plates and having elongate grate fingers carried thereby extending in a direction generally parallel to the direction of movement of the grate plates, said front grate part being ascending in the direction of movement of the grate plates and having laterally spaced apart, downwardly projecting ribs on the underside thereof in a position to engage the grate fingers for supporting the front grate part on the grate support.

7. A two part grate as claimed in claim 6, wherein the inclined end surface of the front grate part has a recess means formed therein defining an air slot between the interengaging inclined end surfaces for cooling of the projection means on the front and rear grate parts.

8. A two part grate as claimed in claim 1, wherein the grate support comprises a plurality of laterally extending plates spaced apart in the direction of movement of the grate plates, and longitudinal, laterally spaced apart grate fingers carried on the plates, said grate fingers having forwardly extending projections, and the front grate part being supported on the projections, said rear grate part having depending portions at the front and rear edges thereof, resting on the fingers whereby a four point support is obtained for the rear grate part.

9. A two part grate as claimed in claim 8, wherein the interengaging means includes inclined end surfaces on the front and rear grate parts producing horizontal and vertical force components whereby the rearward and downward urging of the front grate part is transmitted to the rear grate part in the form of horizontal and vertical force components.

10. A two part grate as claimed in claim 9, wherein a plurality of longitudinally extending slots are formed in the forward edge of the front grate part for cooling, said fastening means comprising an elongate bolt extending in a generally forward and upwardly inclined direction and having an end portion extended through an opening in the grate support and an end portion engaged with a hook means formed on the underside of the front grate part, spring means disposed concentrically relative to said bolt, and nut means threaded onto said bolt compressing said spring means thereby resiliently urging the front grate part downwardly and rearwardly against the rear grate part and against the grate support.

* * * * *